US008303287B2

(12) United States Patent
Peng et al.

(10) Patent No.: US 8,303,287 B2
(45) Date of Patent: Nov. 6, 2012

(54) SPUNBONDING APPARATUS

(75) Inventors: Chao-Chun Peng, Hsinchu (TW); Tzu-Hsiang Huang, Taipei (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 485 days.

(21) Appl. No.: 12/346,003

(22) Filed: Dec. 30, 2008

(65) Prior Publication Data

US 2010/0159049 A1 Jun. 24, 2010

(30) Foreign Application Priority Data

Dec. 24, 2008 (TW) ..... 97150502 A

(51) Int. Cl.
*B28B 21/52* (2006.01)
*B29C 47/26* (2006.01)

(52) U.S. Cl. ..... 425/66; 425/71; 425/83.1; 425/382.2; 425/464

(58) Field of Classification Search ..... 425/66, 425/71, 72.2, 378.2, 382.2, DIG. 217, 83.1, 425/464; 264/172.11, 172.16, 211.14
See application file for complete search history.

(56) References Cited

U.S. PATENT DOCUMENTS

| | | | | | |
|---|---|---|---|---|---|
| 3,436,792 | A * | 4/1969 | Hench | 425/72.2 |
| 4,204,828 | A * | 5/1980 | Peckinpaugh et al. | 425/72.2 |
| 4,261,943 | A * | 4/1981 | McCorsley, III | 264/136 |
| 4,340,559 | A * | 7/1982 | Yang | 264/181 |
| 5,417,909 | A * | 5/1995 | Michels et al. | 264/177.13 |
| 5,599,488 | A * | 2/1997 | Prof e | 264/40.3 |
| 5,798,125 | A * | 8/1998 | Zikeli et al. | 425/72.2 |
| 5,800,840 | A * | 9/1998 | Geus et al. | 425/7 |
| 7,018,188 | B2 * | 3/2006 | James et al. | 425/72.2 |
| 2003/0161904 | A1 * | 8/2003 | Geus et al. | 425/72.2 |
| 2004/0028763 | A1 * | 2/2004 | Schmit et al. | 425/72.2 |

* cited by examiner

*Primary Examiner* — Joseph Del Sole
*Assistant Examiner* — Ryan Ochylski
(74) *Attorney, Agent, or Firm* — McClure, Qualey & Rodack, LLP

(57) ABSTRACT

A spunbonding apparatus includes at least one nozzle, a coagulating tank, a deformation region, a slit passage, and a drawing flow pump. The nozzle extrudes at least one spinning solution. The coagulating tank contains coagulating liquid to coagulate the spinning solution into at least one fiber. The deformation region is located between the coagulating tank and the nozzle. The slit passage is connected to the coagulating tank and allows the fiber to pass therethrough. The drawing flow pump provides a drawing flow to the slit passage.

19 Claims, 1 Drawing Sheet

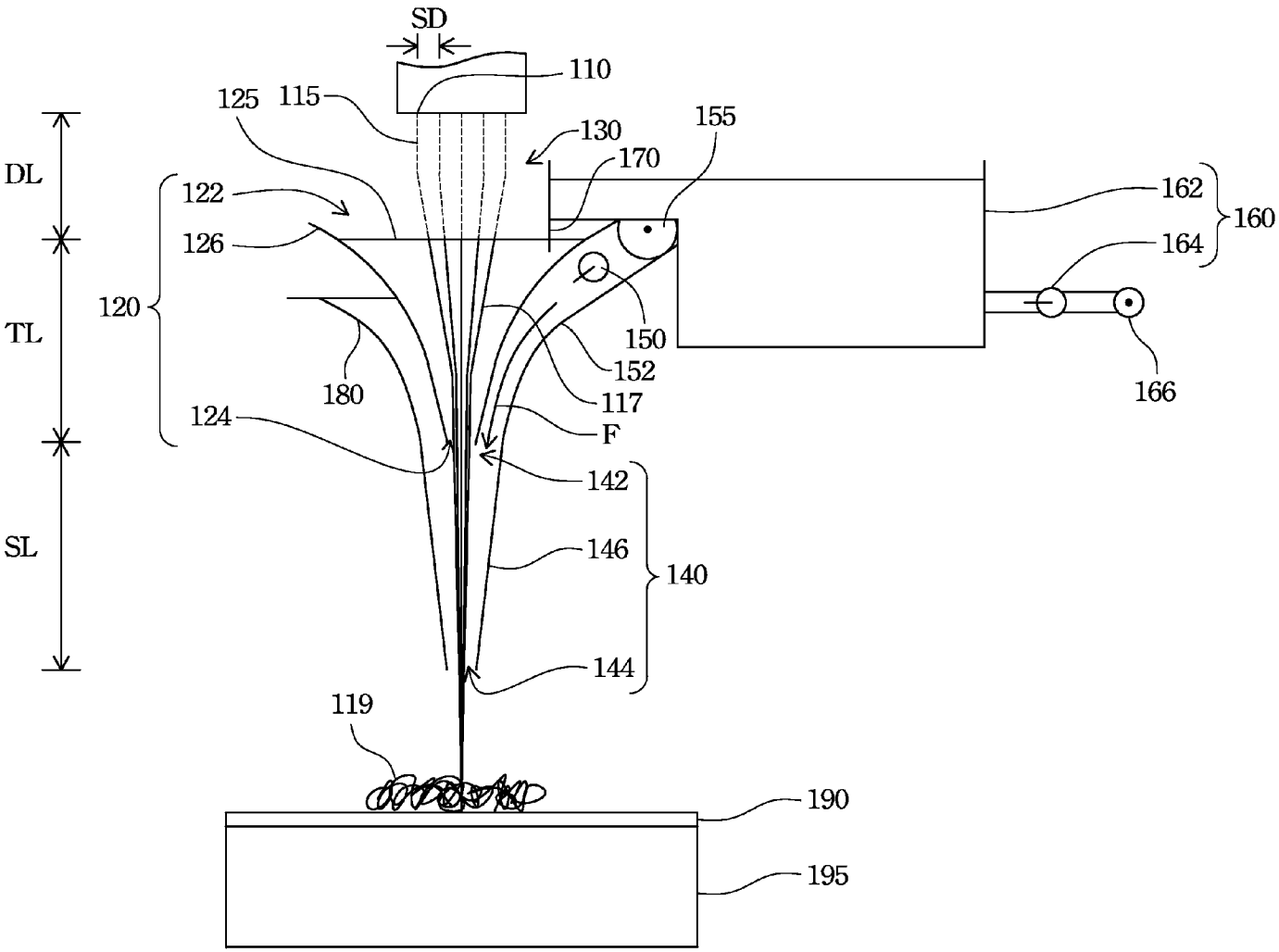
160
162
164
166
155
170
130
110
SD
115
125
122
126
120
124
180
150
152
117
F
142
146
144
140
190
195
119
DL
TL
SL

SPUNBONDING APPARATUS

RELATED APPLICATIONS

This application claims priority to Taiwan Application Serial Number 97150502, filed Dec. 24, 2008, which is herein incorporated by reference.

BACKGROUND

1. Field of Invention

The present invention relates to plastic and nonmetallic article shaping or treating processes. More particularly, the present invention relates to the plastic and nonmetallic article shaping or treating processes, wherein liquid of bath is in motion.

2. Description of Related Art

Nonwovens or non-woven materials are manufactured by binding fibers together in the form of a sheet or web.

One typical method to manufacture nonwovens is melt blowing. Melt blowing is a nonwoven forming process that extrudes a molten thermoplastic through a spin die with high velocity air to form fibers. The fibers are collected as a nonwoven onto a net. However, melt blown fibers are much shorter, and thus melt blown nonwovens typically have a problem of insufficient mechanical strength.

SUMMARY

One aspect of the present invention is a spunbonding apparatus which can manufacture nonwovens by spunbonding.

According to one embodiment of the present invention, a spunbonding apparatus includes at least one nozzle, a coagulating tank, a deformation region, a slit passage, and a drawing flow pump. The nozzle extrudes at least one spinning solution. The coagulating tank contains coagulating liquid to coagulate the spinning solution into at least one fiber. The deformation region is located between the coagulating tank and the nozzle. The slit passage is connected to the coagulating tank and allows the fiber to pass therethrough. The drawing flow pump provides a drawing flow to the slit passage.

According to another embodiment of the present invention, a spunbonding apparatus includes at least one nozzle, a coagulating tank, a slit passage, and a drawing flow pump. The coagulating tank is located apart from the nozzle, and this coagulating tank includes an inlet, an outlet, and a tank wall. The inlet faces the nozzle. The tank wall connects the inlet to the outlet. The slit passage is connected to the outlet of the coagulating tank. The drawing flow pump connects a drawing flow source to the slit passage.

BRIEF DESCRIPTION OF THE DRAWINGS

The only FIGURE is a schematic drawing of a spunbonding apparatus according to one embodiment of the present invention.

DETAILED DESCRIPTION

The only FIGURE is a schematic drawing of a spunbonding apparatus according to one embodiment of the present invention. As shown in the only FIGURE, a spunbonding apparatus includes at least one nozzle 110, a coagulating tank 120, a slit passage 140, and a drawing flow pump 150. The coagulating tank 120 is located apart from the nozzle 110. That is, there is a deformation region 130, i.e. a gap, between the coagulating tank 120 and the nozzle 110. The coagulating tank 120 includes an inlet 122, an outlet 124, and a tank wall 126. The inlet 122 faces the nozzle 110. The tank wall 126 connects the inlet 122 to the outlet 124. The slit passage 140 is connected to the outlet 124 of the coagulating tank 120. The drawing flow pump 150 connects a drawing flow source 155 to the slit passage 140.

In use, the nozzle 110 may extrude at least one spinning solution 115 into the coagulating tank 120. The coagulating tank 120 may contain coagulating liquid 125 to coagulate the spinning solution 115 into at least one fiber 117. In the meantime, the drawing flow pump 150 may provide a drawing flow F to the slit passage 140 to pull the fiber 117 downwards through the slit passage 140. Since a portion of the fiber 117, the spinning solution 115 to be exact, which is located in the deformation region 130 has not coagulated yet, the fiber 117 can be lengthened by the pull of the drawing flow F.

In the only FIGURE, dashed lines represent the spinning solution 115 which has not coagulated yet, and the coagulated fiber 117 is represented by continuous lines.

In the present embodiment, the spinning solution 115 may comprise a cellulose material, for example Peach™ pulp (Lyocell) available from Weyerhaeuser (Asia) Ltd. Table 1 lists the contents of Peach™ pulp.

TABLE 1

Contents of Peach ™ pulp

| Cellulose Content | Degree of Polymerization | Solvent | Solvent Molecular Formula |
|---|---|---|---|
| 10 wt % | 400~700 | N-Methylmorpholine-N-oxide (NMMO) | $O(C_4H_8)NOCH_3$ |

Both the coagulating liquid 125 and the drawing flow F may be water when the spinning solution 115 is Peach™ pulp (Lyocell) available from Weyerhaeuser (Asia) Ltd. It is easily understood that although the coagulating liquid 125, the drawing flow F, and the spinning solution 115 are exemplified in the present embodiment, their spirit and scope of the appended claims should not be limited to the particular embodiment disclosed herein. The person skilled in the art should select a proper coagulating liquid, drawing flow and/or spinning solution according to actual requirements.

The nozzle 110 may be single or plural. For example, the only FIGURE shows that a plurality of the nozzles 110 are arranged in a plurality of rows to extrude the spinning solutions 115 simultaneously.

Furthermore, the area of the outlet 124 of the coagulating tank 120 may be less than the area of the inlet 122 of the coagulating tank 120 to bundle the fibers 117. It is easily understood that although the coagulating tank 120 is exemplified in the present embodiment, their spirit and scope of the appended claims should not be limited to the particular embodiment disclosed herein. The person skilled in the art should select a proper coagulating tank according to actual requirements.

As shown in the only FIGURE, the spunbonding apparatus may further include means 160 for supplying the coagulating liquid 125 to the coagulating tank 120. Specifically, the supplying means 160 may include a supplying tank 162 and a supplying pump 164. The supplying tank 162 is connected to the coagulating tank 120. The supplying pump 164 connects a coagulating liquid source 166 to the supplying tank 162. In use, the supplying pump 164 may pump the coagulating liquid 125 from the coagulating liquid source 166 into the supplying tank 162 until the fluid level of the supplying tank 162 has been higher than the fluid level of the coagulating tank 120. Then, the coagulating liquid 125 can flow from the supplying tank 162 into the coagulating tank 120 by the force of gravity.

In some case, the coagulating liquid 125 which flows from the supplying tank 162 into the coagulating tank 120 may induce a turbulent flow or even waves in the coagulating tank 120. The turbulent flow or the waves may entangle the fibers 117. In order to prevent the entanglement of the fibers 117, a baffle 170 may extend from the supplying tank 162 to or even under the fluid level of the coagulating tank 120 to restrain turbulence in the coagulating liquid 125.

The spunbonding apparatus of the present embodiment may further include a drawing flow passage 152. The drawing flow passage 152 connects the drawing flow pump 150 to the slit passage 140 to direct the drawing flow F towards the slit passage 140. Moreover, in order to prevent the drawing flow F from flowing into the coagulating tank 120 to induce a turbulent flow, an overflow 180 may be located opposite the drawing flow passage 152. The coagulating liquid 125 and/or the drawing flow F may flow out of the slit passage 140 through the overflow 180 when it becomes too full. When the spinning solution 115 is Peach™ pulp (Lyocell) available from Weyerhaeuser (Asia) Ltd, the overflow 180 may be connected to a recycling device to recycle the solvent, i.e. N-Methylmorpholine-N-oxide (NMMO), from the coagulating liquid 125 and/or the drawing flow F.

In the present embodiment, the slit passage 140 may include an inlet 142, an outlet 144, and a wall 146. The inlet 142 of the slit passage 140 is connected to the outlet 124 of the coagulating tank 120, the overflow 180, and the drawing flow passage 152. The area of the outlet 144 of the slit passage 140 is equal to the area of the inlet 142 of the slit passage 140. The wall connects the inlet 142 of the slit passage 140 to the outlet 144 of the slit passage 140. That is, the slit passage 140 may be a long pipe with a constant width. The width of the slit passage 140 may be 1-100 mm, and the length of the slit passage 140 may be 100-1000 mm, 200-500 mm, or 400-450 mm.

After the fibers 117 pass through the slit passage 140, the fibers 117 may be collected as a nonwoven web 119 on a net 190. There may be a vacuum pump 195 under the net 190 to suck the nonwoven web 119. Then, the nonwoven web 119 may be bonded into a nonwoven by any kind of bonding method, for example use of binders, needle felting, hydro-entanglement, use of solvents, thermal bonding, chemical bonding, or mechanical intertwining.

WORKING EXAMPLE

A plurality of working examples are disclosed below. In those working examples, a series of tests were run to determine the respective sizes of the fibers manufactured by the spunbonding apparatus disclosed in the above-mentioned embodiment. The parameters described before are not repeated hereinafter, and only further information is supplied to actually perform the spunbonding apparatus.

In each working example, the fibers were manufactured by the spunbonding apparatus of the only FIGURE, wherein the spinning solution was Peach™ pulp (Lyocell) available from Weyerhaeuser (Asia) Ltd, and both the coagulating liquid and the drawing flow were water. Tables 2-7 list the size of the spunbonding apparatus of each working example. Table 8 lists the manufacture parameters of each working example. Table 9 lists the average diameter, the diameter variance, and the draw ratio of the fibers of each working example.

TABLE 2

| Size of Spunbonding Apparatus | | | |
|---|---|---|---|
| Working Example | Area of Nozzle Plate ($mm^2$) | Nozzle Space SD (mm)[1] | Inner Diameter of Nozzle (mm) |
| 1-3 | 135 mm × 12.2 mm | 4 | 0.25 |

Note

[1]Both the column spacing and the row spacing are 4 mm.

TABLE 3

| Size of Spunbonding Apparatus | | | |
|---|---|---|---|
| Working Example | Length of Deformation Region DL (mm) | Length of Coagulating Tank TL (mm) | Length of Slit Passage SL (mm) |
| 1-3 | 150 | 400 | 400 |

TABLE 4

| Size of Spunbonding Apparatus | | |
|---|---|---|
| Working Example | Inlet Area Of Coagulating Tank ($mm^2$) | Outlet Area Of Coagulating Tank ($mm^2$) |
| 1-3 | 216 mm × 62.5 mm | 216 mm × 1 mm |

TABLE 5

| Size of Spunbonding Apparatus | | | |
|---|---|---|---|
| Working Example | Inlet Area of Overflow ($mm^2$) | Outlet Area of Overflow ($mm^2$) | Length of Overflow (mm) |
| 1-3 | 216 mm × 1 mm | 216 mm × 10 mm | 250 mm |

TABLE 6

| Size of Spunbonding Apparatus | | | |
|---|---|---|---|
| Working Example | Inlet Area of Drawing Flow Passage ($mm^2$) | Outlet Area of Drawing Flow Passage ($mm^2$) | Length of Drawing Flow Passage (mm) |
| 1-3 | 216 mm × 15 mm | 216 mm × 2 mm | 450 mm |

TABLE 7

| Size of Spunbonding Apparatus | | |
|---|---|---|
| Working Example | Inlet Area of Slit Passage ($mm^2$) | Outlet Area of Slit Passage ($mm^2$) |
| 1-3 | 216 mm × 4 mm | 216 mm × 4 mm |

TABLE 8

Manufacture Parameters of Each Working Example

| Working Example | Supplying Pump Horsepower (HP) | Supplying Pump Frequency (Hz) | Drawing Flow Pump Horsepower (HP) | Drawing Flow Pump Frequency (Hz) | Extrusion Temperature (° F.) | Single Nozzle Extrudate (g/min) | Total Flow ($m^3$/min) | Velocity (m/min)[2] |
|---|---|---|---|---|---|---|---|---|
| 1 | 3.4 | 10.06 | 4 | 21 | 270 | >1.5 | 0.1536 | 173.44 |
| 2 | 3.4 | 20.12 | 4 | 31 | 270 | >1.5 | 0.2412 | 272.35 |
| 3 | 3.4 | 40.18 | 4 | 49 | 270 | >1.5 | 0.3552 | 401.08 |

Note
[2]the velocity of the coagulating liquid was sensed at the outlet of the slit passage.

TABLE 9

Size of Fibers

| Working Example | Average Diameter (μm) | Diameter Variance (%) | Draw Ratio |
|---|---|---|---|
| 1 | 140 | 21 | 3.2 |
| 2 | 30 | 28 | 69.4 |
| 3 | 19.6 | 12 | 156.3 |

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A spunbonding apparatus comprising:

at least one nozzle for extruding at least one spinning solution;

a coagulating tank for containing coagulating liquid to coagulate the spinning solution into at least one fiber, the coagulating tank having a tank wall, the tank wall being liquid-holding such that the coagulating liquid is directly held by the tank wall;

an outer wall covering the tank wall of the coagulating tank, wherein the outer wall and the tank wall of the coagulating tank define a drawing flow passage therebetween;

a deformation region located between the coagulating tank and the nozzle;

a slit passage connected to the coagulating tank for allowing the fiber to pass therethrough; and a drawing flow pump for providing a drawing flow to the slit passage through the drawing flow passage.

2. The spunbonding apparatus of claim 1, further comprising:

a supplying tank connected to the coagulating tank, wherein the fluid level of the supplying tank is higher than the fluid level of the coagulating tank.

3. The spunbonding apparatus of claim 2, further comprising:

a supplying pump connecting a coagulating liquid source to the supplying tank.

4. The spunbonding apparatus of claim 2, further comprising:

a baffle extending from the supplying tank to the fluid level of the coagulating tank.

5. The spunbonding apparatus of claim 1, wherein the drawing flow passage connects the drawing flow pump to the slit passage; and further comprising an overflow located opposite the drawing flow passage.

6. The spunbonding apparatus of claim 5, wherein the slit passage comprises:

an inlet connected to the coagulating tank, the overflow, and the drawing flow passage;

an outlet, wherein the area of the outlet is equal to the area of the inlet; and a wall connecting the inlet to the outlet.

7. The spunbonding apparatus of claim 1, wherein the width of the slit passage is 1-100 mm.

8. The spunbonding apparatus of claim 1, wherein the length of the slit passage is 100-1000 mm.

9. The spunbonding apparatus of claim 1, wherein a plurality of the nozzles are arranged in a plurality of rows.

10. The spunbonding apparatus of claim 1, wherein the coagulating tank comprises:

an inlet facing the nozzle; and an outlet connected to the slit passage, wherein the area of the outlet is less than the area of the inlet, and the tank wall connects the inlet to the outlet.

11. A spunbonding apparatus comprising:

at least one nozzle;

a coagulating tank located apart from the nozzle, the coagulating tank comprising:

an inlet facing the nozzle;

an outlet; and a tank wall connecting the inlet to the outlet, the tank wall being liquid-holding such that the coagulating liquid is directly held by the tank wall;

an outer wall covering the tank wall of the coagulating tank, wherein the outer wall and the tank wall of the coagulating tank define a drawing flow passage therebetween;

a slit passage connected to the outlet of the coagulating tank; and a drawing flow pump for providing a drawing flow to the slit passage through the drawing flow passage.

12. The spunbonding apparatus of claim 11, further comprising:

a supplying tank connected to the coagulating tank, wherein the fluid level of the supplying tank is higher than the fluid level of the coagulating tank.

13. The spunbonding apparatus of claim 12, further comprising:

a supplying pump connecting a coagulating liquid source to the supplying tank.

14. The spunbonding apparatus of claim 12, further comprising:

a baffle extending from the supplying tank to the fluid level of the coagulating tank.

15. The spunbonding apparatus of claim 11, wherein the drawing flow passage connects the drawing flow pump to the slit passage; and further comprising an overflow located opposite the drawing flow passage.

16. The spunbonding apparatus of claim 15, wherein the slit passage comprises:

an inlet connected to the outlet of the coagulating tank, the overflow, and the drawing flow passage;

an outlet, wherein the area of the outlet is equal to the area of the inlet; and a wall connecting the inlet to the outlet.

17. The spunbonding apparatus of claim 11, wherein the width of the slit passage is 1-100 mm.

18. The spunbonding apparatus of claim 11, wherein a plurality of the nozzles are arranged in a plurality of rows.

19. The spunbonding apparatus of claim 11, wherein the area of the outlet of the coagulating tank is less than the area of the inlet of the coagulating tank.

* * * * *